US005685522A

United States Patent [19]

Randolph, Jr.

[11] Patent Number: 5,685,522

[45] Date of Patent: Nov. 11, 1997

[54] FENCE POST TRIM COLLAR

[76] Inventor: Tedford M. Randolph, Jr., 5131 Eagle Trail, Houston, Tex. 77084

[21] Appl. No.: 430,778

[22] Filed: Apr. 26, 1995

Related U.S. Application Data

[63] Continuation-in-part of Ser. No. 218,650, Mar. 28, 1994, abandoned, which is a continuation-in-part of Ser. No. 109,618, Aug. 20, 1993, abandoned.

[51] Int. Cl.[6] ..... E04H 17/00

[52] U.S. Cl. ..... 256/1; 256/19; 52/170; 47/23

[58] Field of Search ..... 256/1, 19, 32, 256/33, DIG. 5, 59, 65, 14; 47/25, 23, 33, 30 OT, 25 R, 24, 24 T; 52/244, 169.14, 727, 728, 170, 737.5, 736.4, 738.1; 403/230, 232.1

[56] References Cited

U.S. PATENT DOCUMENTS

| | | | |
|---|---|---|---|
| 405,658 | 6/1889 | Campany | 52/170 |
| 3,384,351 | 5/1968 | Turner, Jr. | 256/32 |
| 3,704,004 | 11/1972 | Carter, Jr. | 256/1 |
| 3,713,624 | 1/1973 | Niemann | 256/1 X |
| 3,806,096 | 4/1974 | Eccleston et al. | 251/1 X |
| 3,906,664 | 9/1975 | Hall | 47/66 C |
| 4,478,391 | 10/1984 | Kovach | 256/1 |
| 4,845,889 | 7/1989 | Taylor | 47/23 |
| 4,964,619 | 10/1990 | Glidden, Jr. | 256/32 |
| 5,048,229 | 9/1991 | Campell | 52/736.4 X |
| 5,178,369 | 1/1993 | Syx | 256/32 |
| 5,369,925 | 12/1994 | Vargo | 52/727 X |

FOREIGN PATENT DOCUMENTS

| | | | |
|---|---|---|---|
| 2041694 | 11/1992 | Canada | 47/23 |
| 3540554 | 5/1987 | Germany | 47/25 |
| 8902317 | 4/1990 | Netherlands | 47/33 |
| 2231345 | 11/1990 | United Kingdom | 256/1 |
| 9319266 | 1/1990 | WIPO | 256/DIG. 5 |

*Primary Examiner*—Harry C. Kim
*Attorney, Agent, or Firm*—Rosenblatt & Redano P.C.

[57] ABSTRACT

A fence post trim collar which prevents vegetation growth in the corners between fence posts and fencing material is disclosed. The collar also protects the fence posts from damage by monofilament line trimmers and protects the monofilament in a line trimmer from damage by the fence posts. Accumulation of grass clippings in the corners between the fence posts and the fencing material is also prevented.

12 Claims, 2 Drawing Sheets

FENCE POST TRIM COLLAR

FIELD OF THE INVENTION

This is a continuation-in-part of U.S. Ser. No. 08/218,650 filed Mar. 28, 1994, which is a continuation-in-part of U.S. Ser. No. 08/109,618 filed Aug. 20, 1993, both now abandoned. The invention relates to a trim collar which may be attached to fence post to facilitate monofilament line trimming while protecting the post.

BACKGROUND OF THE INVENTION

Much of the residential and commercial property in this country uses fencing to provide privacy and/or define property lines. While the fencing itself is relatively maintenance-free, vegetation abutting such fencing, particularly lawns, requires regular and frequent maintenance in the form of trimming.

Many forms of fencing, particularly privacy fencing which uses square wooden fence posts, have corners between the fence posts and the fencing where vegetation can grow but is difficult or virtually impossible to trim with a conventional monofilament line trimmer. Furthermore attempts to trim around these posts often results in damage to the posts and/or to the monofilament line. Sharp corners on square fence posts are particularly damaging to monofilament line and may even severe the line. This drastically reduces the useful life of a standard line supply for such a trimmer. In additional to the waste of monofilament, this results in an additional waste of time while the monofilament supply is replaced and the trimmer is rethreaded. It is therefore an object of the present invention to provide a device which will prevent vegetation growth in corners between fence posts and fencing material where it cannot be trimmed by standard monofilament line trimmers. It is a further object of the present invention to provide a device which will protect the fence posts from damage by monofilament line during trimming and will protect the monofilament from damage due to striking the fence posts.

Trimming vegetation growth along a fenceline can be slowed by geometries where extra care must be taken with a monofilament line trimmer, such as the corners between fence posts and fencing material. It is therefore an object of the present invention to provide a device which smooths the transition from the fenceline around the fence post and back to the fenceline, allowing trimming at each fence post to proceed as quickly as it does along the fenceline.

To the extent the vegetation in the corners between the fence posts and the fencing can be trimmed, the clippings tend to accumulate in the corners. Even a conventional blower is sometimes ineffective at removing such clippings from those corners. It is therefore a further object of the invention to provide a device which will prevent such accumulation of grass clippings.

Fences constructed using wooden fence posts suffer substantial irregularities in the fence posts size and/or shape. Fence posts which are nominally of a standard size may actually have dimensions varying from the specifications by a significant percentage. Fence posts from one producer may have square corners, while those from another producer may have rounded or beveled corners. Furthermore exposure to rain, snow, and extreme temperatures may cause the wooden posts to swell, shrink, crack, or warp. It is therefore an object of the present invention to provide a device which can accommodate such irregularities and/or changes in fence post size or shape.

Since many existing fences suffer the problems described above, it is an object of the present invention to provide a device which can be applied to a fence post in an existing fence.

SUMMARY OF THE INVENTION

A fence post trim collar which prevents vegetation growth in the corners between fence posts and fencing material is disclosed. The collar also protects the fence posts from damage by monofilament line trimmers and protects the monofilament in a line trimmer from damage by the fence posts. Accumulation of grass clippings in the corners between the fence posts and the fencing material is also prevented.

DETAILED DESCRIPTION OF THE INVENTION

Figure 1:
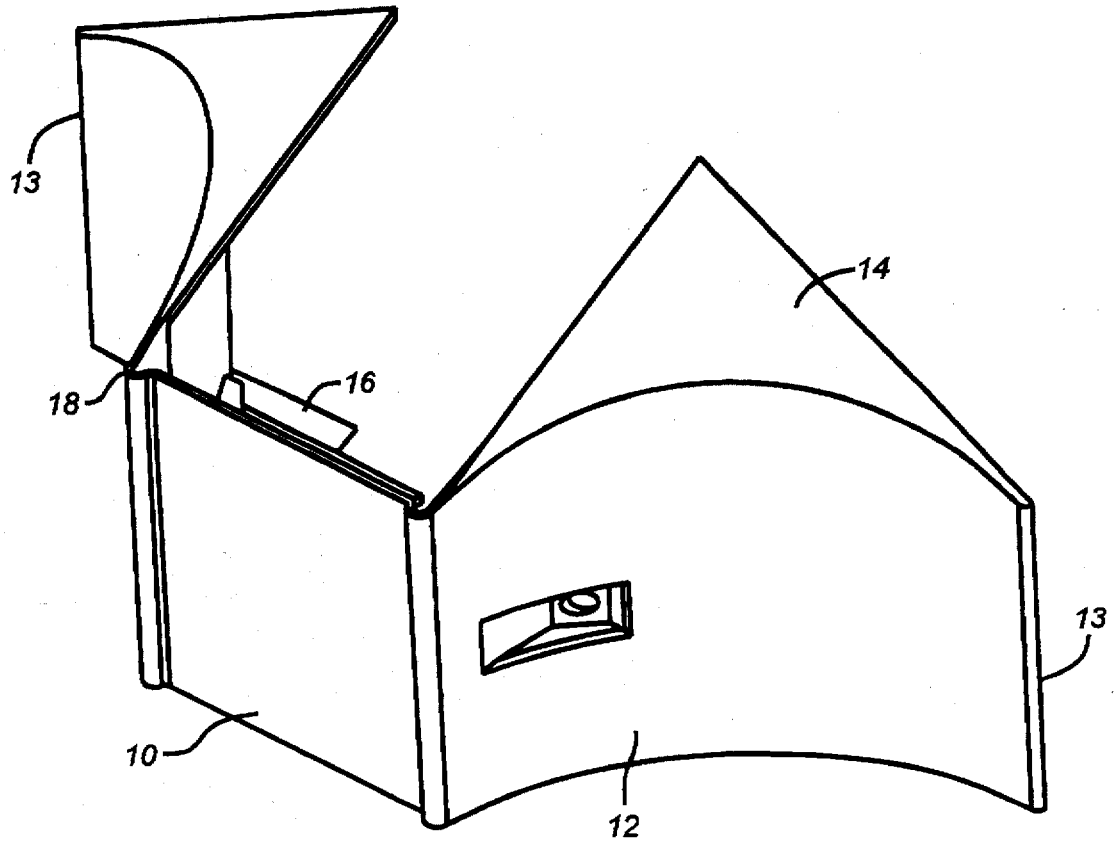
FIG. 1 is a perspective view of the fence post trim collar of the present invention.
Figure 2:
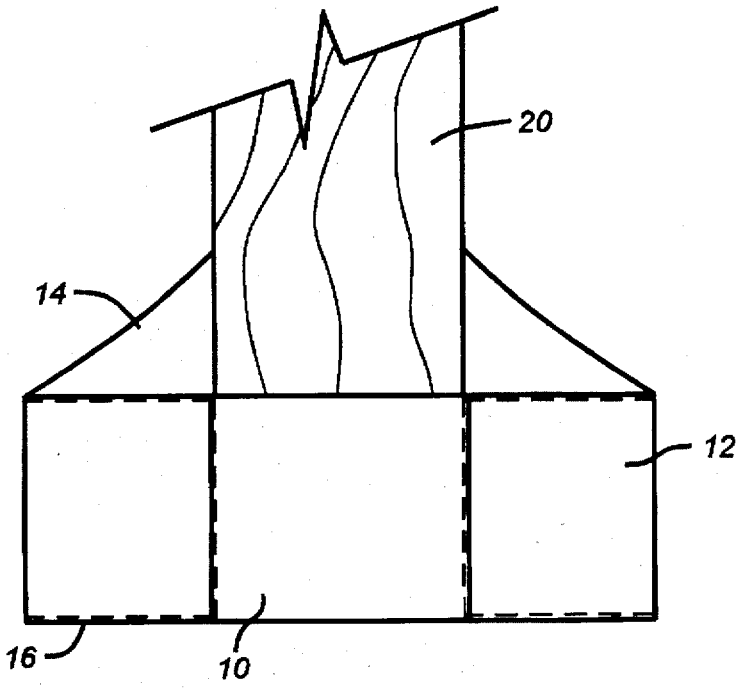
FIG. 2 is a front view of the fence post trim collar attached to a fence post.

The fence post trim collar of the present invention is integrally formed, as by plastic molding, to include a front face 10, side walls 12, top surfaces 14, and bottom surfaces 16. The front face 10 is adapted for placement on the surface of a fence post 20 opposite the fenceline. Side walls 12 project outward from both sides of the front face and behind the front face, while top surfaces 14 project from the upper edges of the side walls and bottom surfaces 16 project from the lower edges of the side walls.

The collar is preferably attached to the portion of a fence post closest to the ground. When the collar is attached to the fence post by placing the front face 10, 10 against the surface of a fence post 19 opposite the fenceline 12, side walls 32, 42 project from the edges of the front face away from the fence post and toward the fenceline. The front face need not directly contact the surface of the fence post; spacers may be used if desired to fill any space between the front face and the surface of the fence post. The outer ends 13 of the side walls substantially abut or extend adjacent to the fenceline when the fence post trim collar is attached to a fence post.

Figure 3:
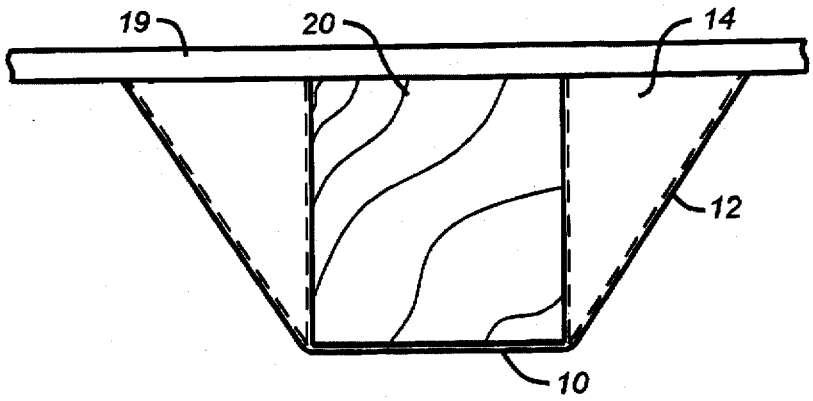
FIGS. 3 and 4, respectively top and bottom views of the collar as attached to a fence post abutting a fenceline, illustrate various configurations for the side walls of the collar.
Figure 4:
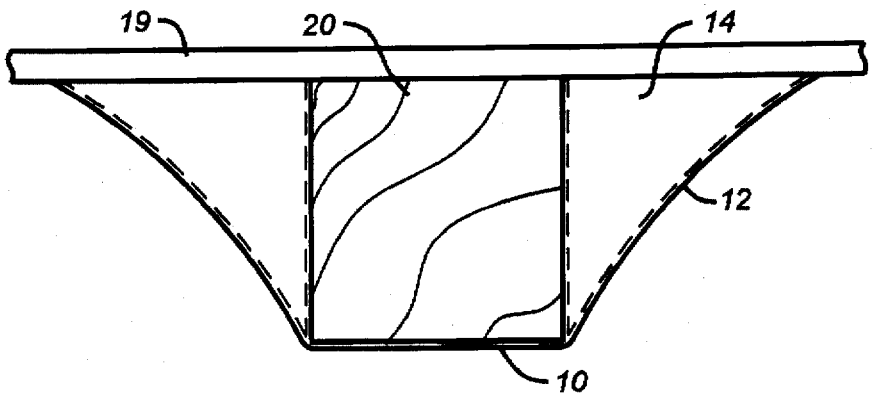
Figure 5:
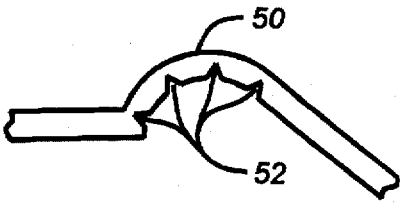
FIG. 5 is a detail of the end view of one embodiment of the rounded projection where the front face and side walls of the collar join.

As seen from FIGS. 3 and 4, in a horizontal cross-section of the collar the front face 10 the side walls 12 and the existing fenceline 19 form the perimeter of a generally trapezoidal shape. The side walls 12 make up the two nonparallel sides of the trapezoid. The front face 10 makes up the shorter parallel side of the trapezoid. The existing fenceline 19 forms the longer parallel side of the trapezoid. However the collar has an open back allowing application to an existing fence.

The bottom surfaces 16 of the collar, which are essentially triangular, project substantially perpendicularly from the lower edges of the sidewalls toward the fence post and the fenceline. The free edges of the bottom surfaces substantially abut or extend adjacent to the fence post and fence line when the collar is attached to a fence post. These free edges may be trimmed to accommodate variances in size or shape of the fence posts. The bottom surface serves to inhibit the growth of vegetation within the region bounded by the sidewalls, the fence post, and the fenceline by preventing light and moisture from reaching that region and by providing a physical barrier to any sprouting vegetation.

The top surfaces 14 of the collar, which also prevent light and moisture from reaching the region bounded by the side walls, the fence post, and the fenceline, may either supplement or substitute for the bottom surfaces. Like the bottom surfaces, the top surfaces are essentially triangular, projecting from the upper edges of the side walls toward the fence post and the fenceline. The free edges of the top surfaces also substantially abut or extend adjacent to the fence post and the fenceline. The top surfaces may project substantially perpendicularly from the side walls or at an oblique (greater than 90 degrees) angle and may also be trimmed. Angling the top surfaces helps prevent vegetation clippings from accumulating on the top surfaces and is preferred.

While a functional collar need only include either the top or the bottom surfaces, it is preferred that both be provided and that the top surfaces be obliquely angled with respect to the side walls. The regions bounded by the side walls, the fence post, and the fenceline are thereby provided protection against accumulation of vegetation clippings within such region, as well as a double barrier to light and moisture and a physical barrier to vegetation growth within such region.

The side walls may be straight 12 or curved 12. Regardless, they should project a great enough distance along the fenceline away from the fence post so that trimming along the fenceline around a fence post and back again along the fenceline may progress smoothly and without minimal interruption. Thus the collar speeds trimming by eliminating geometries where time and care must be taken to trim, creating instead smooth transition points along the fenceline at the site of each fence post.

The joinder of the side walls to the front face is preferably accomplished by way of rounded projections 18, creating a J-shaped cross-section. The rounded corners facilitate flexibility of the side walls with respect to the front face to accommodate irregularities and/or changes in the fence post size or shape. While the collar's plastic construction may provide some inherent flexibility, it is preferable that the flexing which allows movement of the side walls relative to the front face be localized at the point of connection of the side walls and the front face. Otherwise bowing of the front face might allow vegetation to sprout between the front face and the fence post. Because of the leverage effect created when the force is applied in either direction to the front face, the rounded projections enable the side walls to move relative to the front face with flex of the collar being primarily localized within the rounded projections. Such localization may be enhanced by providing V-shaped groves 52 along the length of the inside surface of the rounded projections 50.

Figure 6:
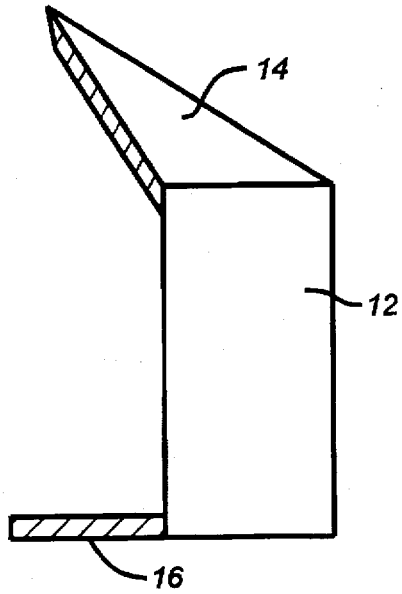
FIG. 6 is a side view a section taken at Y—Y' in FIG. 4.

FIG. 6 is an illustration of the side view of the collar showing the angling of the top surfaces 14 connected to the side walls 12 which are connect to the bottom surfaces 16 of the collar. This angling of the top surfaces helps prevent vegetation clippings from accumulating on the top surfaces and is preferred.

The foregoing description is explanatory and descriptive of the invention. It will be understood by those of ordinary skill in the art that changes in the form, materials, or construction described may be made without departing from the spirit of the invention.

The invention claimed is:

1. A fence post trim collar attachable to a fence post supporting an existing fenceline comprising:

a front face adapted for placement adjacent a front face the fence post, said front face having first and second sides;

side walls integrally joined to said front face and projecting from said sides of the front face away from each other and the fence post and toward the existing fenceline when said front face is placed adjacent to the fence post, and each of said side walls having top and bottom walls respectively attached thereto. wherein said top and bottom walls of the respective side walls are adapted to project toward a respective side of the fence post and the existing fenceline.

2. The fence post trim collar of claim 1 wherein said side walls have joined to said front face by means of rounded projections which flex to allow said side walls to move slightly relative to said front face.

3. The fence post trim collar of claim 1 wherein said side walls each has an outer end extending adjacent to the existing fenceline when said front face is placed adjacent the fence post.

4. The fence post trim cellar of claim 1 wherein said top walls are joined to said side walls and projecting at an oblique angle from said sides toward the fence post and toward the existing fenceline when said from face is placed adjacent the fence post.

5. The fence post trim collar in claim 1 wherein said top wall has an existing fenceline and fence post edges and said existing fenceline edge extending adjacent the existing fenceline and said fence post edge extending adjacent the fence post when said front face is placed adjacent the fence post.

6. The fence post trim collar in claim 1 wherein said bottom wall has an existing a fenceline and fence post edges said existing fenceline edge extending adjacent the existing fenceline and said fence post edge extending adjacent the fence post when said from face is placed adjacent the fence post.

7. The fence post collar of claim 1 wherein said bottom wall projects substantially perpendicularly from the respective side wall.

8. The fence post collar of claim 1 wherein said top wall projects obliquely from the respective side wall.

9. A fence post collar comprising:

a front face;

a plurality of side walls joined to said front face and projecting away from each other and behind said front face, wherein the front face and the side walls together defining an open back allowing application of the fence post collar onto an existing fence post; and each of said plurality of side walls having top and bottom walls respectively attached thereto, wherein said top and bottom walls of the respective side walls projecting behind said front face end being adapted to project toward a respective side of the existing fence post.

10. The fence post collar of claim 9 wherein said bottom wall projects substantially from the side wall and said top wall projects obliquely from the side wall.

11. The fence post collar of claim 9 wherein said side walls and said front face form a joint which allows slight flex of said side walls relative to said front face.

12. The fence post collar of claim 11 wherein said joint allowing slight flex includes a rounded projection between said side wall and said front face.

* * * * *